US005176192A

United States Patent [19]

Judkins et al.

[11] Patent Number: 5,176,192

[45] Date of Patent: Jan. 5, 1993

[54] SHADE AND BOTTOMRAIL THEREFOR

[75] Inventors: Ren Judkins, Pittsburgh; Ralph Jelic, Valencia, both of Pa.

[73] Assignee: Verosol USA Inc., Pittsburgh, Pa.

[21] Appl. No.: 624,312

[22] Filed: Dec. 4, 1990

Related U.S. Application Data

[63] Continuation-in-part of Ser. No. 340,301, Apr. 19, 1989, Pat. No. 4,974,656, which is a continuation-in-part of Ser. No. 30,167, Mar. 25, 1987, abandoned.

[51] Int. Cl.[5] ..... E06B 3/94

[52] U.S. Cl. ..... 160/84.1

[58] Field of Search ..... 160/84.1, 173, 178.1, 160/290.1

[56] References Cited

U.S. PATENT DOCUMENTS

| | | | |
|---|---|---|---|
| 1,956,116 | 4/1934 | Carver | 160/84.1 |
| 3,439,725 | 4/1969 | Haimovitz et al. | 160/84.1 |
| 3,777,800 | 12/1973 | Susoev | 160/84.1 |
| 4,647,488 | 3/1987 | Schnebly et al. | 160/84.1 X |
| 4,753,281 | 6/1988 | Wagner | 160/84.1 |
| 4,813,468 | 3/1989 | Fraser | 160/84.1 |
| 4,852,627 | 8/1989 | Peterson et al. | 160/84.1 |
| 4,901,419 | 2/1990 | Voss | 160/84.1 X |
| 4,974,656 | 12/1990 | Judkins | 160/84.1 |

*Primary Examiner*—David M. Purol

*Attorney, Agent, or Firm*—Buchanan Ingersoll; Lynn J. Alstadt

[57] ABSTRACT

This invention relates to a shade, a bottomrail therefor and a method for the manufacture thereof. The shade is pleated and has the two sections forming each rear projecting pleat secured together to form a rear projecting tab. Cord holes are formed in each of the tabs. A generally triangular in cross section bottomrail is provided which is designed to assist in offsetting and disguising the roll of the shade caused by the fabric resilience. The generally triangular bottomrail includes a housing comprised of a main body having a cavity therein and a tongue extending in a direction opposite the rear face of the shade body. The tongue has a termination point at one end opposite the main body and the housing further includes a leaf extending from the termination point of the tongue to the main body with the leaf forming a side of the generally triangular bottomrail. The housing additional includes a cord receiving arrangement mounted therein.

18 Claims, 6 Drawing Sheets

ALL THE WAY DOWN

START UP

HALF WAY

TIGHT STACK

FIG. 20
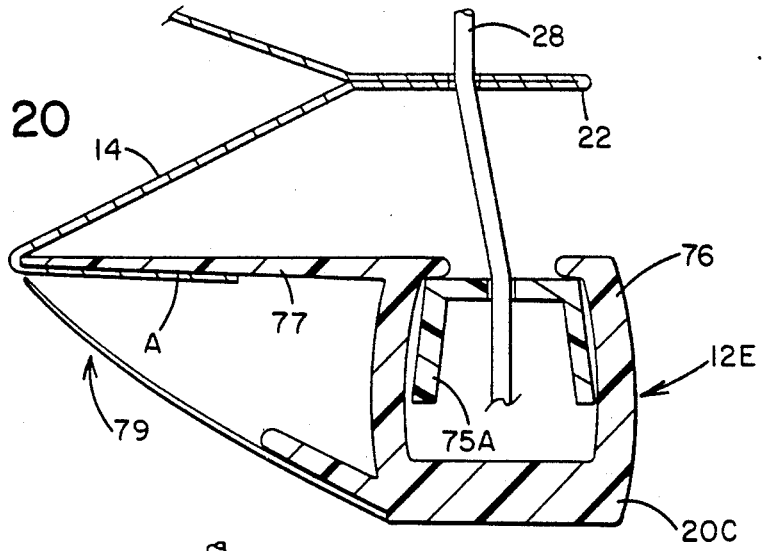
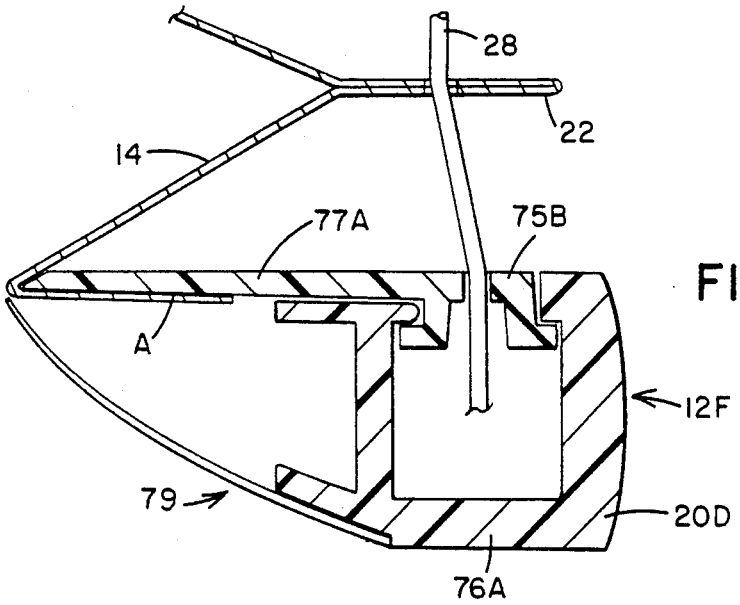
FIG. 21
FIG. 22
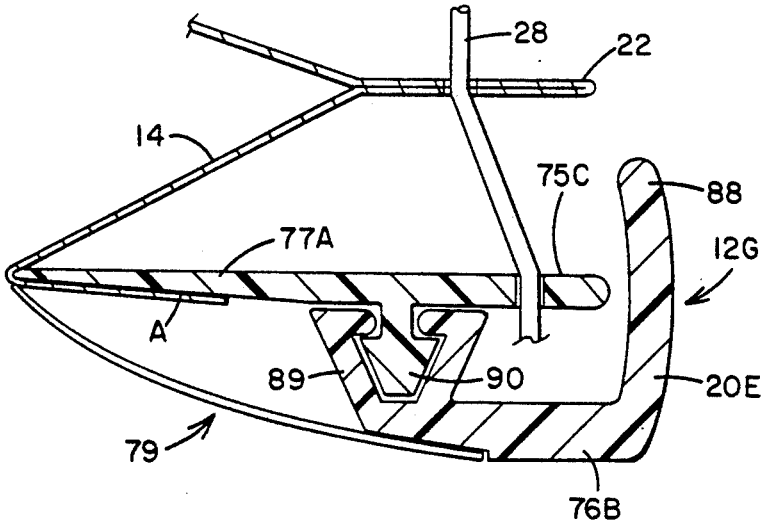

SHADE AND BOTTOMRAIL THEREFOR

RELATED APPLICATION

This application is a continuation-in-part application Ser. No. 340,301, filed Apr. 19, 1989, now U.S. Pat. No. 4,974,656 which is a continuation-in-part of application Ser. No. 030,167 filed Mar. 25, 1987, now abandoned.

FIELD OF THE INVENTION

This invention relates to a pleated shade construction and method for the manufacture thereof and more particularly, a pleated shade construction and bottomrail therefor which results in the cords and cord holes not being visible from the front of the shade and in enhanced durability and energy efficiency.

BACKGROUND OF THE INVENTION

In a standard pleated shade construction, a piece of material is prepleated into a plurality of horizontal sections which stack one on top of the other when the shade is in its raised position. Alternate pleats face toward the front and rear of the shade. Each section has at least one hole punched through the center thereof which holes are aligned when the shade is folded. Normally, there would be two or more aligned rows of holes formed in the shade sections. Cords passing through the aligned holes are utilized to control the raising and lowering of the shade and to maintain the accordion stacks.

One problem with this construction is that short segments of cord are visible in each of the forward-facing pleats of the shade when the shade is in its lowered position. In some applications, the appearance of these cords is not aesthetically acceptable. A more serious problem is the holes in the shade sections which pass bright light rays during the day and which permit room light to be seen and reduce privacy at night. Another problem with having cord holes is that they reduce the insulating effect of the shade. Further, while the standard pleated shades, particularly ones having a metalized layer, provide some level of insulation, they are of only limited value as a vapor barrier.

Another limitation with existing pleated shades is that it is virtually impossible to repair a portion of a large shade which is defective or has become damaged by splicing in a replacement section, a capability which is desirable in large shades, and it is virtually impossible to splice together two sections of shade to achieve a shade of a desired length, forcing shades to be cut to custom lengths, or to achieve a desired aesthetic effect.

An ability to easily and inexpensively splice shades would also reduce production costs by permitting flaws to be cut from pieces of material and the cut ends spliced, thereby minimizing material wastage. Finally, it is now difficult to fit a shade to an opening which is wider than standard bolt widths. By pleating along the length of the bolt, a shade of any desired width could be fabricated, with the desired length achieved by splicing.

While some of the problems discussed above are overcome by existing honeycomb shades which are formed by securing together cylinders of the desired material which have opposed creases preformed therein, these shades are relatively complicated and expensive to manufacture and are not adapted to the requirements of certain applications.

Another approach to providing a pleated shade without cord holes and without visible cords is to in some manner provide a tab extending behind each rear pleat with the cord holes being formed in such tabs. This construction however results in the cords being positioned behind the center of gravity of the shade. This and other factors result in such shades experiencing a phenomenon known as "pleat reversal" wherein one or more front or nose pleats open and move toward the cord while the rear projected tabs become almost parallel to the cords This phenomenon can occur whenever, as a result of various forces exerted on the shade and tabs, certain tabs are caused to assume an angle of approximately 45° or greater to the horizontal. Substantial difficulties have been experienced in designing relatively small pleated shades, for example shades having approximately a one inch pleat, which do not experience this pleat reversal phenomenon.

SUMMARY OF THE INVENTION

In accordance with the above, it is an object of this invention to provide a pleated shade construction which does not result in cords and holes being visible from the front of the shade, which provides enhanced energy efficiency, which provides stronger and more durable pleats which are less likely to pull out in use and which provides enhanced rigidity in some applications while still being relatively simple and inexpensive to fabricate and providing design flexibility and adaptability to numerous applications.

A more specific object of this invention is to provide a pleated shade in accordance with the above which utilizes rear projecting tabs with cord holes therethrough which shade is constructed so as not to be subject to the pleat reversal phenomenon Another object of this invention is to provide a pleated shade construction which permits two sections of pleated shade to be easily and invisibly spliced together Lastly, a further object of this invention is to provide a bottomrail for use with a shade having rear projecting tabs with cord holes therethrough. This bottomrail is designed to balance the shade and reduce rolling of the shade during operation. It is also intended to have a more aesthetic appearance while pivoting or rolling through a range of positions as the shade is raised providing additional strength for the greater weight of tabbed stacks.

This invention overcomes the problems and achieves the objectives indicated above by providing a shade which has a headrail, a bottomrail, and a piece of material having a plurality of pleats preformed therein, alternate pleats projecting towards the front and back of the,material. The material is connected at one end to the headrail and at the other end to the bottomrail. A means is provided for securing together the two sections of material forming each of the back projecting pleats along substantially the entire width of the material to form a narrow tab projecting from the rear of each of such pleats. The sections may be secured together by welding, gluing, sewing or other suitable means. To avoid pleat reversal, the tabs each have a length between approximately 5/16" to ⅜" and the sections of material after pleating have a length of approximately ¾" to 1⅛". Cord holes are formed in each of the tabs, corresponding holes being accurately aligned, and a cord is provided which extends from the headrail through each aligned set of cord holes to the bottomrail. At least one of the cords is adapted, when operated, to control the raising and lowering of the shade. The rigidity of the pleats may be substantially enhanced by providing a double-weld joint for the tab or by otherwise providing a multiple or continuous bond between the two fabric layers forming the tab. The joints used to form the tabs may be used as splice joints to secure together two pieces of material either for repair of a defective or damaged piece of material in manufacture or the field, to achieve a desired aesthetic effect, to customize the length of a shade, or for other purposes. The energy efficiency of the shade may be enhanced by providing a metalized coating or layer for the rear surface of the shade.

Pleat reversal for the shade may be further inhibited by assuring that the cord holes in the tabs are not more than 20" apart, that a cord hole in each tab is no more than 1½" from each edge of the shade and that the center of each cord hole is closer to the forward or bond line edge of the tab than to the rear edge of the tab, the center of each cord hole preferably being as far forward in the tab as possible while assuring that the entire cord hole is within the tab. Further, the diameter of each cord hole should be no more than approximately twice the diameter of the cord passing through the hole. The bottomrail should preferably have a generally triangular cross section with the cords connected off center to the rear side of the rail, and means provided for weighting the rear portion of the rail to inhibit rolling of the pleated stack during raising and lowering of the shade. The pleated material should also be connected to the headrail at least at the tab bond line for top section of material and preferably the entire top section of the shade should be attached to the rail. Pleat reversal may also be inhibited by coating each front projecting pleat or nose pleat with a stiff material having good adhesion to the pleated material, or by placing a thin adhesive bond line behind each front projecting pleat resulting in a small tab being formed projecting from each nose pleat. Finally, a strip of pleated material may be provided for at least selected ones of the cords which material has holes therethrough through which the cord may pass and which overlays the rear portion of the shade, including the tabs, in the area of the cord. The length of each of such strips is shorter than the combined length of a tab and remaining section and the strips are preferably not attached to either the headrail or bottomrail. A slit may be provided adjacent each of the holes in the strip, permitting the strips to be retrofitted over the cords.

The energy efficiency of the shade may be further enhanced by providing a second piece of material positioned behind the first. If the second piece of material has tabs formed in the same manner as the first piece, the pieces of material may be hung with the tabs facing each other and a means may be provided for maintaining a predetermined relative position between corresponding tabs of said pieces of material. In particular, the tabs may be adjacent each other or may be offset by one pleat from each other and may be held in a desired relative position by having a single cord passing through corresponding cord holes in the tabs of both pieces of material. When the tabs are adjacent, they may be held together either by butt bonding, by being butted and secured to a common bridging piece of material or by being overlapped and glued, sewn, welded or otherwise secured together. The latter configurations result in a honeycomb-like structure. If the rear piece of material has tabs formed with the front piece so that both pieces have common tabs, and the rear piece is shorter than the front piece, a shade having a prismatic configuration is provided. The rear layer of material may be formed of plastic film or other nonpermeable material providing a vapor barrier.

The bottomrail is specifically designed for use with a rear tabbed shade, but may be utilized with any pleated shade to accomplish a desired aesthetic effect. It is utilized with the tabbed shade to accomplish four major goals. First, it provides a weight to pull the shade in the downward direction. Second, it is balanced to help offset curling or rolling of the shade because of the resiliency of the shade material. Third, the profile of the bottomrail is designed with a rounded triangular shape to match the appearance of the rolling of the stack and also helps to integrate the appearance of the bottomrail with the pleated appearance of the shade. Finally, the rigidity of the rail is placed at the rear side to better support the cord and load.

The foregoing and other objects, features, and advantages will be apparent from the following more particular description of preferred embodiments of the invention as shown in the accompanying drawings.

BRIEF DESCRIPTION OF THE DRAWINGS

FIG. 34 is a side cross sectional view of the lower portion of the shade shown in FIG. 1 taken along the line 3—3 in FIG. 1.

FIG. 20 is a side sectional view of a fifth embodiment of an improved bottomrail for use with a rear-tabbed shade as shown in FIGS. 16A—D.

FIG. 21 is a side sectional view of a sixth embodiment of an improved bottomrail for use with a rear-tabbed shade as shown in FIGS. 16A—D.

FIG. 22 is a side sectional view of a seventh embodiment of an improved bottomrail for use with a rear-tabbed shade as shown in FIGS. 16A—D.

DETAILED DESCRIPTION

Figure 1:
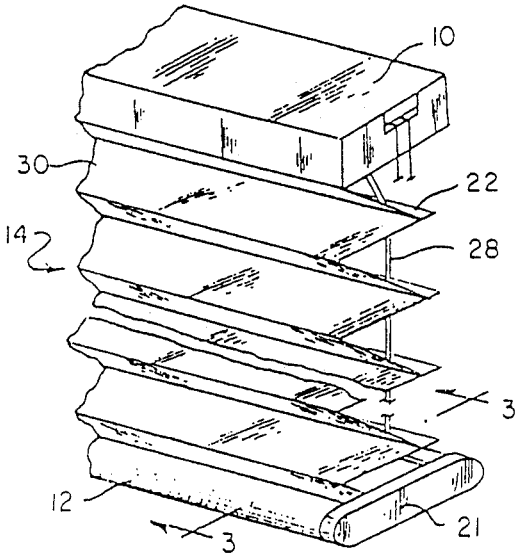
FIG. 1 is a front perspective view of a portion of a shade of a first embodiment of the invention which shade is formed of a piece of material.
Figure 2:
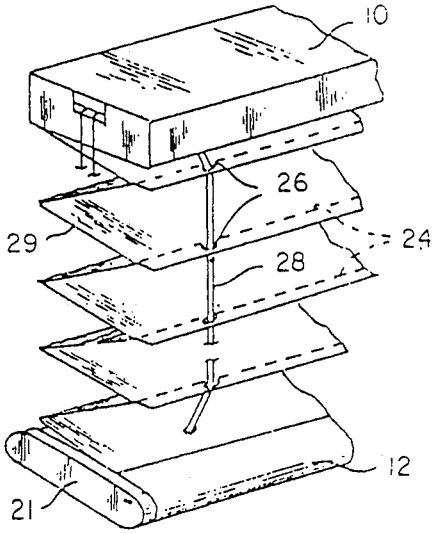
FIG. 2 is a rear perspective view of a portion of the shade shown in FIG. 1.
Figure 3A:
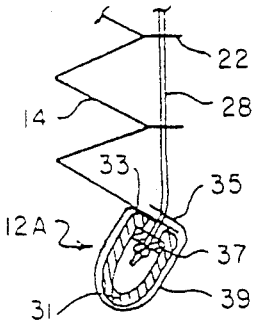
FIG. 3A is a side cross sectional view of the lower portions of a shade having an alternative second bottomrail structure.
Figure 3:
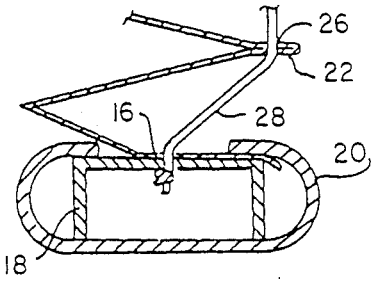

Referring to FIGS. 1-3, it is seen that the shade of a first preferred embodiment of the invention includes a headrail 10, which may be of standard construction and does not form part of the present invention, and a bottomrail 12. A piece of prepleated material 14 has its top pleat connected to headrail 10 in a conventional fashion and has its bottom pleat 16 connected to bottomrail 12 in a manner which may be best seen in FIG. 3. Referring to FIG. 3, it is seen that bottom pleat 16 is glued or otherwise secured to the top of profile 18 which profile fits inside oval-shaped housing 20. An end cap 21 is fitted on each end of housing 20 to give footrail 12 a finished appearance. If desired, a piece of material (not shown), which is either the same as material 14 or contrasts thereto in an aesthetically pleasing manner, may be fitted over housing 20 with its ends secured between profile 18 and housing 20 and may be further secured to the housing by gluing or other suitable means.

In accordance with the teachings of this invention, and as may be best seen in FIG. 2, the two sections of material forming each of the rear pleats of material 14 are secured together along substantially the entire width of the shade and at a point a short distance from the pleat to form a plurality of rear tabs 22. The joint or seam 24 which results in the tabs 22 may be formed by welding, sewing, gluing or other suitable means. For a preferred embodiment of the invention, the joint is formed by ultrasonic welding. The length T (FIG. 13) of the tabs 22 will vary with application, but it has been found that to minimize the pleat reversal problem, the length T should be in the range of ⅜" to 5/16" and pleat sections should have a length (L) after the tab is formed in the range of ¾" to 1⅛".

The tab should not be too small since the tab counterbalances the pleat and thereby improves the appearance and operation of the shade. However, if the tab is too large relative to the remaining section of the shade, the shadows of the tab become too dominating and detract from the appearance of the shade when light is behind it. The product also becomes uneconomical where the tab is too large since it takes more fabric to cover a window of a given size. Finally, due to the normal shrinkage in manufacture, the material may bow forward at the center causing an undesirable wrinkling of the tab. This wrinkling is reduced if the tab is shorter.

Similarly, if the size of the remaining length L is too small, the pleat reversal problem gets worse. This may be because the flexibility of the fabric between creases or pleats decreases as the length decreases, and therefore the pleats are more stretched when open. The short length L, like a long length T, also makes the shades less economical to manufacture since more material is required for a given size window or other opening being covered.

Similarly, while as the length L gets longer, the pleat reversal problem diminishes, other problems arise. The additional weight of the tab flattens out the nose pleat of the material and the fabric overall, causing the shade to loose its pleated appearance. As the length L approaches the upper limit indicated above, pleat reversal from a flattening of the nose pleats and tab pleats become a more serious problem and the shade may loose its pleated appearance.

Each of the tabs 22 has at least one cord hole 26 formed therein. The exact number of cord holes will vary with the width of the shade and the rigidity of the material, but most shades will have at least two cord holes. The cord holes in each of the tabs are aligned so that a cord 28 may pass therethrough. In addition to passing through the cord holes 26 in tabs 22, cord 28 enters headrail 10 in a substantially conventional fashion and passes over conventional mechanisms including locking mechanisms in headrail 10 and out the side thereof to control the raising and lowering of the shade. Cord 28 may also pass through the center of bottom section 16 and through a hole in the center of profile 18. The lower end of cord 28 may be knotted as shown in FIG. 3, may be attached to a ring or washer, or may be held in bottomrail 12 in other conventional fashions. Cord 28 passing through the center of profile 18 permits footrail 12 to hang straight when the shade is lowered.

There is much that can be done with the cords 28 and cord holes 26 to reduce the pleat reversal problem. First, the cords passing through a given tab should be no more than 20" apart and the spacing S (FIG. 13A) between a cord hole 26 and the edge of the fabric should be no more than 1½". To the extent these requirements cannot be met with two cords, additional cords may be required. More important, the closer the hole 26 is to bond line 24, while still having the entire hole within tab 22, the better the performance is against pleat reversal. This may be best seen in FIG. 13A where the hole 26 virtually abuts the bond line 24. For example, for a tab having a length (T) of ⅜", the center of the hole might be ¼" from the back edge of the tab and ⅛" from the front edge or bond line 24. In any event, the center line of each hole 26 should be well forward of the center of tab 22.

The reason why having the hole forward improves performance is that the hole is a pivot and the center of support for the shade with respect to the cord. Having the hole as far forward as possible allows the tab to balance the pleat and folding motion of the individual pleat, thus inhibiting reduces the movement arm for forces applied by the cord to the tabs and rolling of the shade stack which can cause random fluctuations in forces applied to tabs and preventing movement of the tab away from the horizontal position, thus inhibiting pleat reversal.

The cord 28 moving up through cord holes 26 may also tend to apply a force to tabs 22 to move them away from the horizontal. The magnitude of this force depends on the roughness of the edge of the hole, the roughness of the cord, and the hole alignment. The accurate alignment of the holes 26 in each stack is therefore critical for a shade of the type shown in FIGS. 1, 2, 13, 13A, etc.

Another factor in the movement of the tab from the horizontal is clearance of the fit between the hole 26 and cord 28. The tighter the ratio between the cord and hole diameters, the more force is required to bend the fabric around the cord or to bend the cord around the fabric. However, if the fit is too tight, the friction force will be greater which may also cause movement of the tab away from the horizontal. Thus, in determining the relative size of the cord and the hole, a balance must be struck between the factors indicated above, which balance to some extent depends on the smoothness of the cord 28. For a standard plisse cord, such as one used for plisse shades, a 1 to 2 ratio, (i.e., a hole diameter twice the diameter of the cords) produces very good results. For a smooth monofilament cord, a 3 to 4 ratio appears to produce best results.

Figure 13:
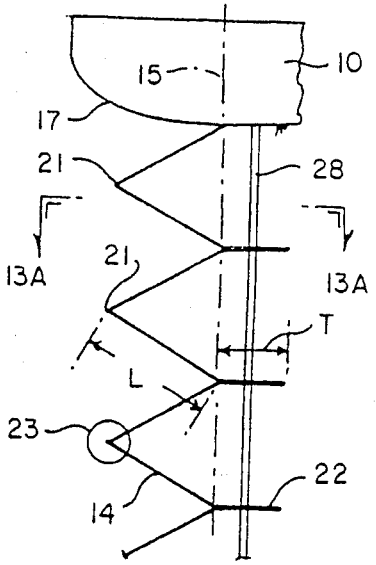
FIG. 13 is a side sectional view of the top portion of a shade of the type shown in FIGS. 1 and 2 illustrating a preferred means of attaching the pleated material to the headrail, preferred dimensions and the area of coating for the nose pleat for an embodiment where this pleat is coated.
Figure 13A:
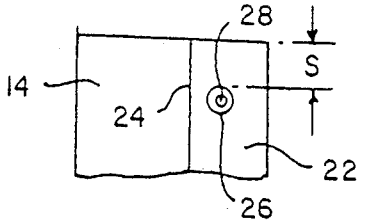
FIG. 13A is a partial view of a single section taken along the line 13A—13A in FIG. 13.

FIG. 13 illustrates the optimum manner in which the pleated fabric 14 should be hung from headrail 10. While in most shades the pleated fabric is supported, as shown in FIG. 1, from the headrail at a point different from the center line or point where the cords are, this can cause the fabric to move relative to the cord and to roll or swing as the shade descends. Since such swings can result in a tilting of the tab and thus contribute to pleat reversal, the fabric for the shade of this invention is best hung from the bond line (illustrated by dashed line 15 in FIG. 13). This keeps the plane of the bond line constant relative to the cord and reduces the friction on the hole edges. Ideally, the entire uppermost section 17 of the material 14 is attached to the bottom of headrail 10 by a suitable means such as adhesive, tape, staples, or the like.

Similarly, the off center nature of the shade in FIGS. 1, etc., causes the fabric to roll in a generally S-shaped stack as the shade is lifted. This shape can cause the cord to rub on the edge of one hole and not the adjacent hole. This effect depends on a lot of factors including the pleat, tab, and fabric uniformity and contributes to the random nature of pleat reversal. The bottom of the stack is supported by the cord and the cord touches the back side of all holes. This is illustrated for example in FIG. 16C. In the S curve, the middle of the stack is balanced on the bottom stack and could tip either way. However, friction is minimal because of the balanced nature of these pleats. The top of the stack is hanging from the front edge of the headrail and can have the cord rubbing on the front or the back depending on the distance from the headrail. Problems can potentially develop in the transition from the middle to the top. There may be times when adjacent pleats have significantly different friction loads and such asymmetries cause pleat reversals.

In addition to the various steps indicated above, another partial solution to the pleat reversal problem is to use a bottom rail having a rounded triangular shape such as that of the bottomrail 12B shown in FIGS. 16A–16D. A weight W may be placed in this bottom rail to offset the S roll of the stack. It also centers the wide web section of the shade beneath the load for the stiffness needed to support a relatively heavy shade. This shape also is visually more pleasing than a generally rectangular or oval rectangular shape such as that shown in FIG. 3 because the viewer does not have a perpendicular bias that accompanies a rectangular shape. This is important because the bottomrail tilts to different orientations during movement of the rail up and down. The degrees of the tilt varies with factors including the age of the shade, with typical tilts being shown in FIGS. 16A–16D respectively for the shade all the way down, at the beginning of a lifting operation, halfway up a lifting operation and when the shade is in its fully raised position.

Figure 16A:
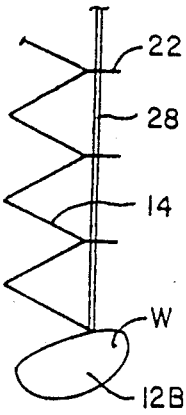
FIGS. 16A—16D are side sectional views of an alternative bottomrail construction and of a portion of the shade adjacent thereto, illustrating the appearance and position of this bottomrail when the shade is at various points in its path of travel.
Figure 16B:
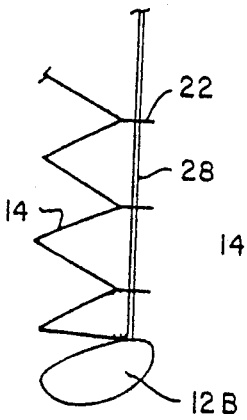
Figure 16C:
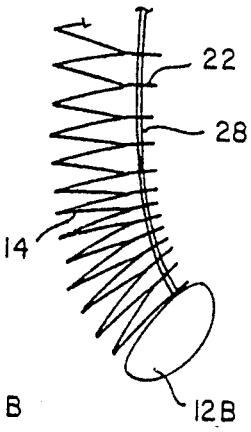
Figure 16D:
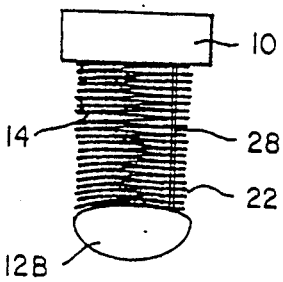

FIGS. 18–24 illustrate several embodiments of a bottomrail to be used with the rear tab shade shown in FIGS. 1 and 2. These bottomrails are specifically adapted to blend with the pleated appearance of the remainder of the shade body. Each utilizes a nose configuration which is intended to mimic both the shape and texture of the shade material. A blunted or otherwise truncated nose pleat may be also utilized The bottomrail also provides a weight which assists in the lowering of the shade in an even and aesthetically pleasing manner. The weight is preferably positioned within the bottomrail to minimize the rolling of the shade during operation. This is accomplished by placing the center of mass of the bottomrail offset from the centerline of the shade body. Most fabrics utilized in this shade construction are manufactured from synthetic fibers which have resiliency and are not easily formed into a pleated configuration. During operation, the shade is lowered which additionally assists in the flattening of the pleated areas of the shade body. Over time this reduces the ability of the shade to be symmetrically stacked and compressed. The effect of this is illustrated in FIG. 16C and provides for an awkward looking shade when mounted on a window or the like. While some rolling of the shade is inevitable considering the use of these fabric materials, this rolling can be reduced by careful placement of the weight in the bottomrail. This weight should preferably be placed asymmetrically in the bottomrail such that it serves to counterbalance out the resiliency and the weight of the pleated material, which tends to pivot the shade forward on the cord support fulcrum. This preferably on the side of the center of mass of the bottomrail corresponding to the tabbed edges of the shade material.

Figure 18:
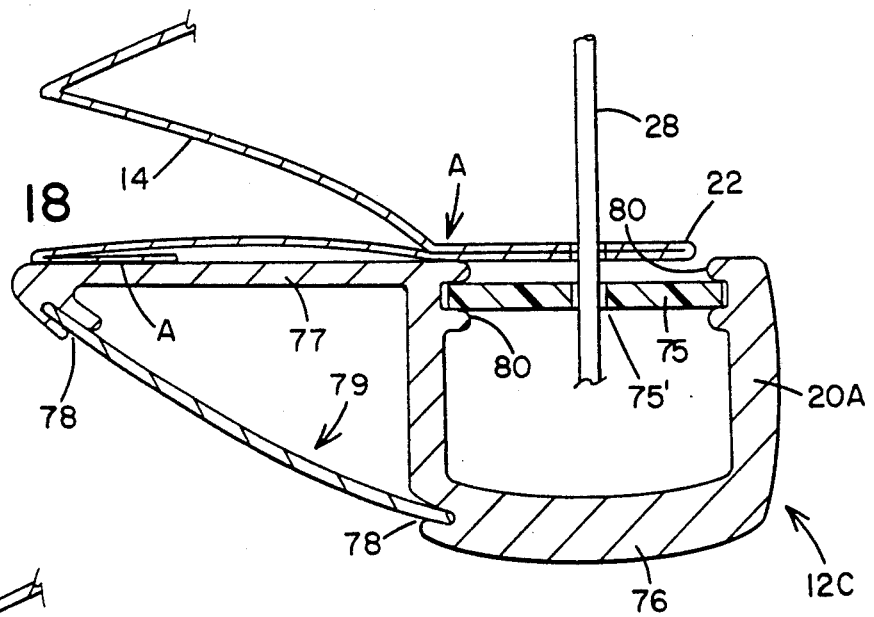
FIG. 18 is a side sectional view of a third embodiment of an improved bottomrail for use with the rear-tabbed shade as shown in FIGS. 16A—D.

Referring now to FIG. 18, a third embodiment of the bottomrail 12C is comprised of a housing 20A having a main body portion 76 and a tongue 77 extending outwardly therefrom. Housing 20A is preferably constructed of metal or some other material of substantial weight. The majority of the weight of the device is contained in the thick wall portions of the main body 76 and provides an asymmetrically weighted housing 20A. Tongue 77 extends outwardly from the main body 76 in the same direction as are intended for the nose pleats of the prepleated material 14. The prepleated material is affixed with an adhesive at points A to the tongue 77 while tab 22 is permitted to move freely along cord 28. A portion of the prepleated material 14 is laid along the top of tongue 77 before being affixed at points A so as to cover tongue 77 from view and to simulate an additional section of prepleated material. A series of tracks 78 are provided in the main body 76 and the outermost end of tongue 77 to contain a leaf 79 which may be alternatively constructed of the same fabric as prepleated material 14 or a corresponding or complimentary piece of alternative material such as aluminum. The selection of this material may be selected according to aesthetic choices and serves as a decorative device only. The triangular construction of the bottomrail 12C, however, is intended to simulate an additional pleat at the bottom of prepleated material 14.

A pair of slots 80 are further provided within the internal cavity of main body 76 and permit the insertion of a retainer 75, which is intended to be inserted along the entire length of the bottomrail. It should specifically be noted that retainer 75 may be constructed of a single element or of a number of elements which are sequentially inserted into the track. It is further noted that small discontinuous elements might be utilized immediately adjacent the cords. Retainer 75 is preferably of lightweight plastic. The retainer 75 has at least one hole 75' passing therethrough intended to receive the end of cord 28. The number of holes 75' necessary in retainer 75 is determined by the width of the shade. The number of holes 75' should correspond to the number of cords 28 provided with the shade. The retainer 75 allows the cord 28 to pass therethrough and to be either tied off within the cavity of main body 76 or to be passed along through the cavity for a tie off at one or the other end of the bottomrail.

Figure 19:
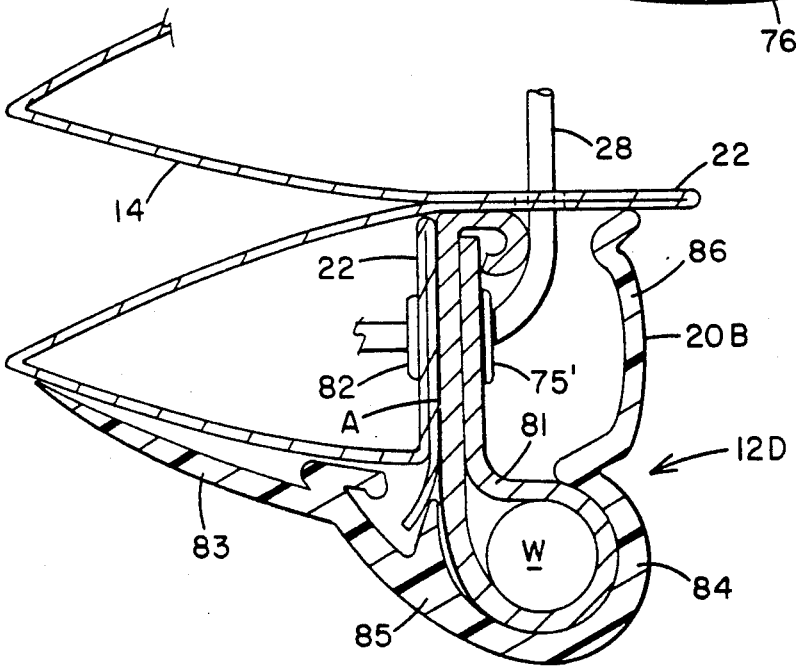
FIG. 19 is a side sectional view of a fourth embodiment of an improved bottomrail for use with a rear-tabbed shade as shown in FIGS. 16A—D.

Referring now to FIG. 19, a fourth embodiment 12D of the bottomrail is shown having a housing 20B which is generally in the form of a distorted "W". A main housing portion 84 is semicircular in cross section and has two arms 85 and 86 extending from the terminal portions thereof. The arm 86 extending upwardly from the rear of the bottomrail is utilized to provide a back for the bottomrail and cover the hardware contained therein. The arm 85 located on the bottom of the bottomrail is adapted to support the nose pleat of the bottomrail and further to provide a mounting surface for the optional guard 83, which protects the lower surface of the bottomrail nose pleat. The bottomrail further comprises an interior support 81 which is mounted within the semicircular main body 84 of the housing 20B. The interior support 81 has a circular bottom section which is adapted to fit snugly within the semicircular main body 84. The interior support 81 extends upwardly therefrom and is provided with a plurality of holes 75'. The holes 75' are arranged in a similar fashion to that described with FIG. 18. An optional weight "W" may be inserted within the center portion of the base of interior support 81. As previously described, the weight of the bottomrail in its entirety is intended to be shifted towards the rear tab side of the piece of prepleated material 14.

The fabric of prepleated material 14 is arranged such that tab 22, as shown in FIG. 19, is affixed with an adhesive at A to the top of the interior support 81. The lowest section of the prepleated material is permitted to form a fabric nose piece which also forms the nose of the bottomrail itself. A last tab 22 is affixed to one face of the interior support 81 and may be held in place by either adhesive or optionally a series of grommets 82 provided to maintain the integrity of hole 75'. In this fashion, the bottomrail has a more exaggerated asymmetrical weight distribution and the nose piece thereof is identical in appearance to the remainder of the pleated shade.

Figure 19A:
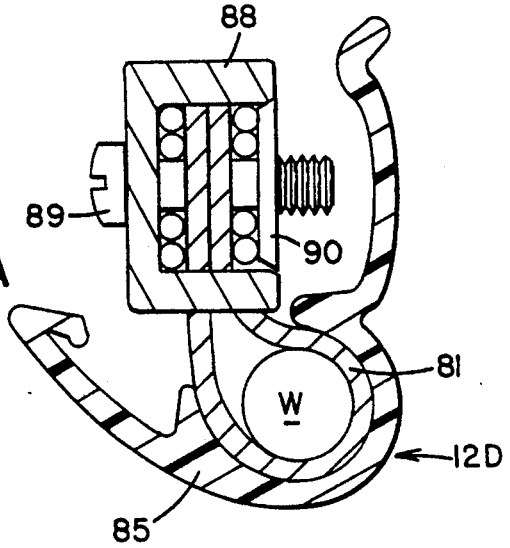
FIG. 19A is a side sectional view of the embodiment of FIG. 19 having a clamp.

FIG. 19A illustrates the embodiment of FIG. 19 with a clamping means for securing the cord to the interior support 81. A clamp body 88 is connected through interior support 81 to a backing plate 90. Tightening of screw 89 allows the clamp to adjustably hold a cord in a given position and allows adjustment thereof after the shade has been completely mounted. It is to be specifically noted that this clamping mechanism may be utilized with any of the embodiments shown herein and is not limited in its application to the embodiment of FIG. 19.

A fifth embodiment 12E of the bottomrail is shown in FIG. 20. The housing 20C is comprised of a main body 76, as in the embodiment of FIG. 18. A majority of the weight of the housing 20C is concentrated in main body 76, which is offset from the centerline of the shade. A tongue 77 extends outwardly from the main body 76 in the direction of the nose pleats of the prepleated material 14. A leaf 79 is affixed by adhesive to the lower surface of the main body 76. The leaf 79 may also be affixed in a track, such as shown in FIG. 19, on main body 76. The cord 28 is affixed to the bottomrail 12E by passing it through a retainer 75A. This retainer operates identically to the retainer 75 shown in FIG. 18, and may be utilized with a cord 28 that is knotted within the cavity of main body 76 or with an embodiment which runs the cord 28 through the length of the bottomrail to be tied off at one end. Additionally, the clamp member of FIG. 19A may be utilized The retainer 75A is held in place in the cavity of main body 76 by winglike members extending from the sides thereof. Again, it should be noted that the retainer 75A may be of a single unit or be comprised of several units. Holes (not shown) are provided for the passage of cord 28. The prepleated material 14 is shown affixed to the tongue 77 in a second arrangement, when contrasted with that shown in FIG. 19. These arrangements may be utilized interchangeably, but that shown in FIG. 19 is preferred. In this embodiment, a section of the prepleated material 14 immediately following a pleat is affixed by adhesive at A, along the underside of tongue 77. This edge is then covered by leaf 79.

FIG. 21 illustrates a sixth embodiment 12F of the bottomrail. A main housing 20D is comprised almost solely of the main body 76A. The leaf 79 may be affixed thereto by adhesive or in a track (not shown) as in FIG. 19. Retainer 75B is restrained within the cavity of main body 76A by winglike members, but in this embodiment is itself provided with a tongue 77A extending outwardly in the direction of the nose pleats of the prepleated material 14. As the retainer is preferably made of lightweight plastic, this embodiment further concentrates the weight of the bottomrail asymmetrically in the portion corresponding to the rear of the shade. The material is shown to be affixed in the same manner as that in FIG. 20, but it should be specifically noted that either of the disclosed arrangements may be utilized.

Figure 24:
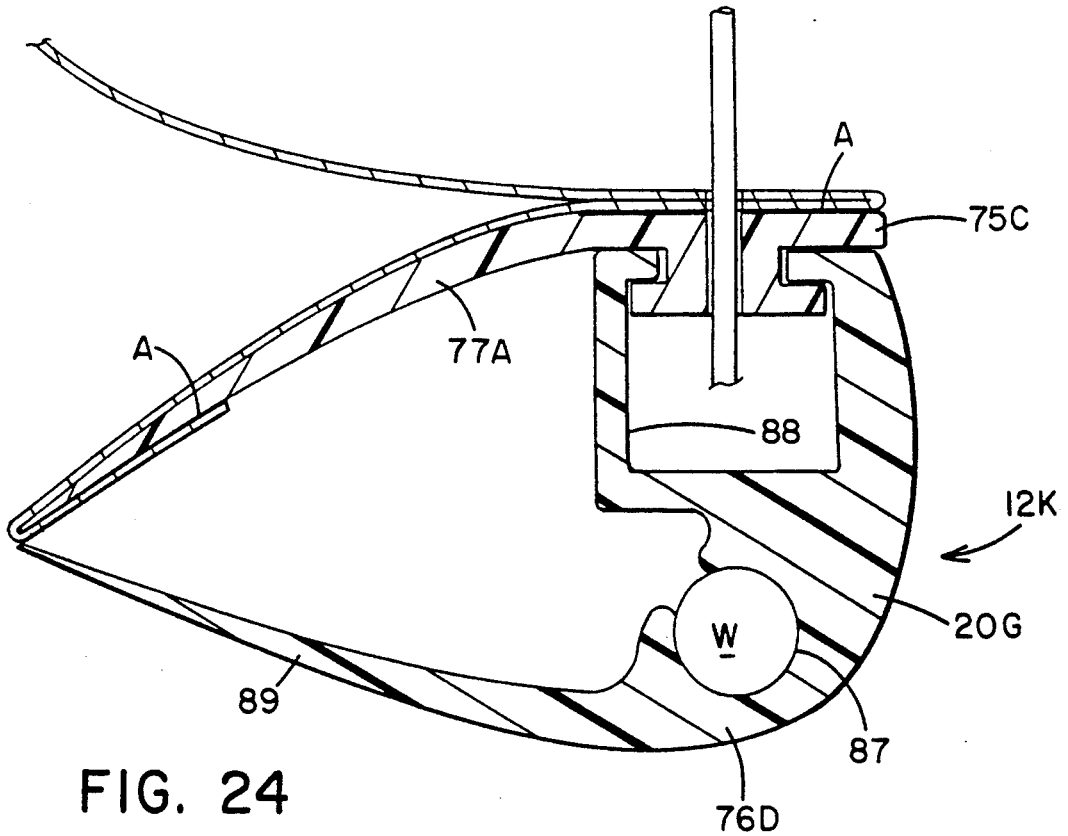
FIG. 24 is a side sectional view of a ninth embodiment of an improved bottomrail for use with a rear-tabbed shade as shown in FIGS. 16A—D.

The device shown in FIG. 24 is related to that of FIG. 21. It shows a ninth embodiment 12K of the bottomrail which utilizes a retainer 75C having a tongue 77A attached thereto. Tongue 77A is shown as being arcuate in FIG. 24 and straight in the remaining figures. It is to be specifically noted that the tongue, whether part of the retainer or the main body, may be alternatively straight or arcuate is shape. A main housing 20G is comprised of main body 76D, which is provided with a cavity 87 to receive and restrain a weight W, which is optional. Whether the weight is utilized or not, it is intended that the weight of the entire bottomrail be asymmetrically arranged such that the center of mass is displaced closer to the tabbed side of the shade body from the centerline of the shade. A support arm 88 is provided on main body 76D to permit the mounting of the retainer 75C. A lower surface 89, which is similar in structure and function as guard 83 shown in FIG. 19, is formed integrally with main body 76D. A separable guard 83 may be utilized interchangeably with the lower surface 89 in each of the embodiments. Adhesive is preferably applied at points A, but may be utilized on the entire surface of the material mounted on tongue 77A.

Referring now to FIG. 22, a seventh embodiment 12G of the bottomrail is illustrated. A main housing 20E is provided with a main body 76B. The main body 76B has an arm 88 extending upwardly from the rear portion to conceal the cord hardware inside the bottomrail for rigidity and weight. The main body 76B further comprises a socket 89, which is adapted to receive a pin 90 affixed to the retainer 75C. This pin and socket combination serves to restrain the retainer. The retainer 75C is again provided with the tongue 77A upon which the material is mounted. The leaf 79 is attached as previously described.

Figure 23:
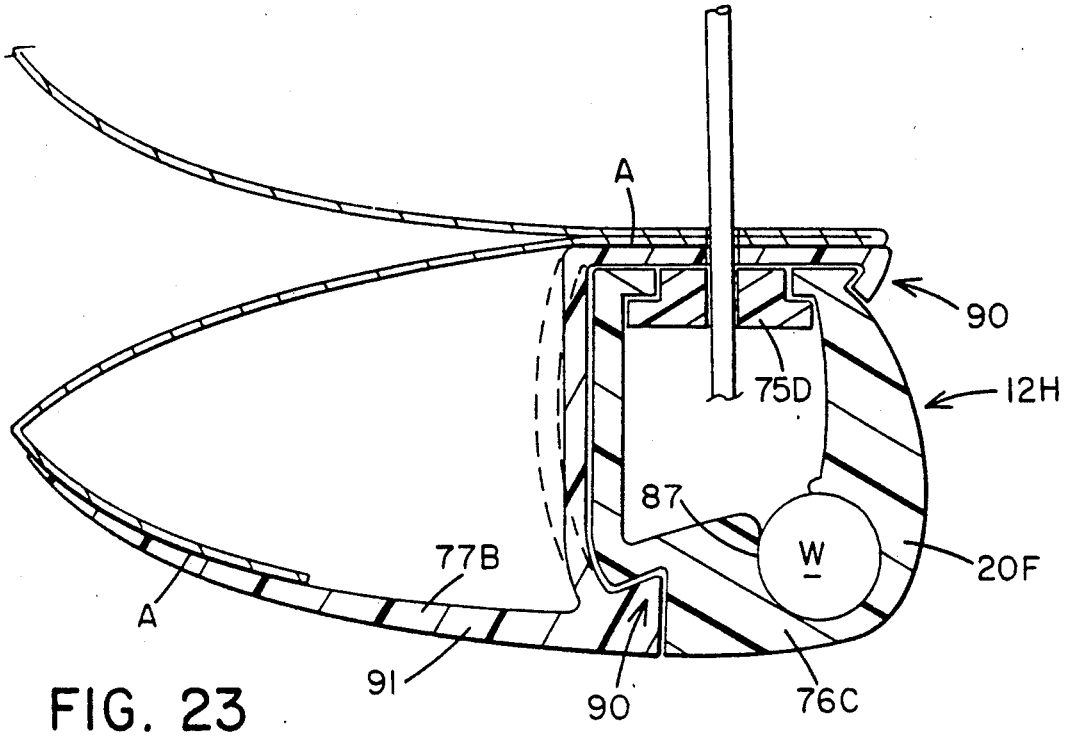
FIG. 23 is a side sectional view of a eighth embodiment of an improved bottomrail for use with a rear-tabbed shade as shown in FIGS. 16A—D.

FIG. 23 illustrates an eighth embodiment 12H of the bottomrail. A main housing 20F is comprised almost solely of the main body 76C. Retainer 75D is restrained within the cavity of main body 76C by winglike members. As with the embodiment of FIG. 24, a cavity 87 is provided for an optional weight W. A clamp member 91 is mounted on main body 76C at mounting points 90 and may be bowed slightly (as shown in broken line) to achieve a snug fit. A tongue 77B extends from the lower portion of the clamp member 91 and forms the bottom side of the triangular bottomrail. The material of the shade body is mounted with an adhesive at points A on the terminal point of the tongue 77B and the upper surface of the clamp 91.

FIG. 13 illustrates another step which can be taken to improve the integrity and thereby minimize the likelihood of pleat reversal. The pleat strength and memories of the front or nose pleat 21 may be improved by spraying or otherwise applying a topical coating to this pleat. This may for example be done by coating a material which is stiff and has good adhesion to the fabric of material 14 to the fabric after it is pleated and welded. The coating may for example be sprayed on the nose pleats while the fabric is tightly stacked so that only the creased area is coated. This area is represented by the circle 23 in FIG. 13. The coating may for example be a cyano-acrylic or may be a modified urethane-acrylic coating or a melamine based coating similar to those used for pleated shades or a vinyl based coating commonly used for roller shade fabrics.

Figure 14:
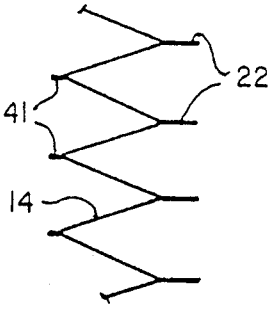
FIG. 14 is a side sectional view of a portion of a shade of an eleventh embodiment of the invention illustrating the use of a nose tab.

FIG. 14 illustrates another technique which may be utilized to improve the nose pleat strength and memory. For this embodiment, an adhesive bond line is laid down on the back side of each nose pleat 21 and the sections forming this pleat are then pressed together to form a small tab 41 at each nose pleat. This not only improves the nose pleat integrity, but should also improve the appearance of the shade, particularly for shades having longer pleat section lengths L.

Figure 15B:
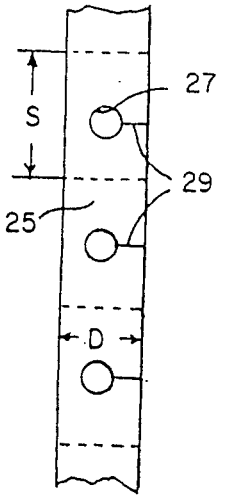
FIG. 15B is a front view of a strip suitable for use with the embodiment of the invention shown in FIG. 15A.
Figure 15A:
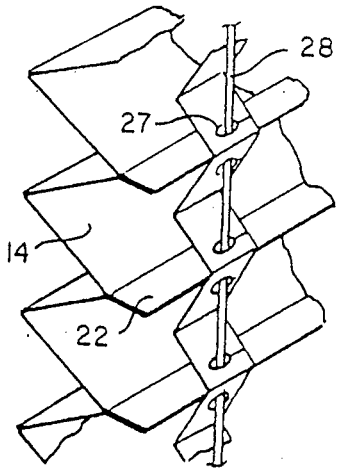
FIG. 15A is a rear-side perspective view of a portion of a shade of a twelfth embodiment of the invention.

FIGS. 15A and 15B illustrate still another technique which may be utilized to improve pleat integrity and inhibit pleat reversal. Referring to these figures, a strip of pleated material 25 is provided which has cord holes 27 formed therein. Strips 25 may have a width dimension D in the $\frac{1}{4}''$ to $\frac{3}{4}''$ range and extend such that the length(s) of strip section is greater than or equal to the pleat length (L) but less than (L+T). A cross section through the configuration shown in FIG. 15A would look the same as that shown in FIG. 12. The strips 25 could be formed for example of a clear plastic film so as to minimize visibility and shadowing through the shade, and have a stiffness roughly equal to that of the shade fabric material. The strip 25 inhibits pleat reversal by constraining the tab so as to keep it from pivoting from the horizontal and also by serving to block the nose pleat so as to keep it from reversing.

The strips 25 can be mounted with the shade when it is originally fabricated so that the cords pass through both the shade and the strip during initial fabrication, or slits 29 may be provided on the holes 27 permitting the strips to be retrofitted on the cords in the field. Strips 25 would typically only be used in an environment where a pleat reversal problem developed and may only be used on the portion of the shade having such problems, for example, the top half of the shade where the pleats are more likely to pull out than on the bottom. Preferably the strips 25 would be used only on a portion of the shade and will not be connected to either the headrail or the bottomrail.

Still another technique which can be utilized to reduce pleat reversal arises from the fact that, because of the way tabs are normally formed, one side is typically stiffer than the other. Either by experience or by testing, it can be determined which side of the tab is weaker and the material mounted such that the weaker side of the tab is facing downward. This means that the tab weakness does not augment the cord friction problem and serves to inhibit the tab from being bent upwards by the cord when the shade is being raised.

Since cords 28 pass through cord holes 26 in tabs 22 rather than through the center of the sections in material 14, the cords are not visible from the front of the shade providing a pleasing visual appearance. The absence of holes in the sections of material 14 also prevents light and air from passing through such holes and therefore enhances the insulating effect of the shade. This effect may be further enhanced by having a metalized rear layer or coating 29 on material 14. Joints 24 (and nose tabs 41 when used) enhance the memory strength of the pleats in material 14 and reduce the likelihood of the pleats pulling out when a shade, particularly a large heavy shade, is in its lowered position for an extended period of time. Joints 24 and tabs 22 (and nose tabs 41 where used) may also enhance the rigidity of the pleats in some applications.

Figure 4:
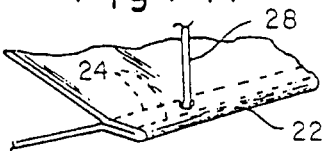
FIG. 4 is a perspective view of a portion of a shade of a second embodiment of the invention.

The memory strength and rigidity of pleats may be significantly enhanced by providing a multiple bond or a continuous bond between the fabric layers forming each tab. For example, a double-weld joint may be provided, as shown in FIG. 4 for a second embodiment of the invention, rather than a single-weld joint as shown in FIGS. 1 and 2, or the two fabric layers may be glued together over substantially the entire area. Particularly with a multiple or continuous bond, the structural rigidity of the material may be increased by as much as 100%, providing the same effect as if a beam or rod were placed in the pleat. Finally, the tabs 22 are structural members to which elements, such as spacers, may be attached. Spacers are elements which control the amount by which a pleat may be opened, thus preventing pleats from being opened beyond a point desired for a particular aesthetic effect and preventing stress from being put on pleats which might result in their being pulled out.

FIG. 3A shows another alternative embodiment 12A for the bottomrail. For this embodiment of the invention, a triangular steel rail 31 is fitted into the bottom rear pleat of material 14. Tabs 33 and 35 at the top and bottom of this pleat respectively fit over the top of rail 31 and rail 31 is held in place in the pleat by passing cord 28 through the cord holes in tabs 33 and 35 and through an opening in the top of rail 31, the cord being held in rail 31 by passing it through a washer 37 and knotting it. Material 14 is preferably attached to rail 31 in the area 39 by glue or other suitable means.

With the bottomrail configuration of FIG. 3A, the rail is supported primarily by the material 14 and therefore tends to hang at an angle as shown in FIG. 3A, appearing substantially as an additional pleat in the material.

Figure 4A:
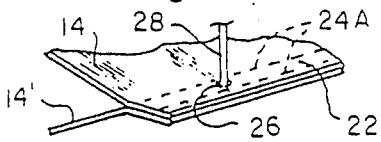
FIG. 4A is a rear perspective view of a portion of a shade of a third embodiment of the invention.

FIG. 4A shows an alternative embodiment of the invention wherein a joint 24A, in this case a double-weld joint such as that shown in FIG. 4, is being utilized to splice together two pieces of material 14 and 14' rather than to merely secure together two sections of the same piece of material. The joint 24A still results in the formation of a tab 22 having cord holes 26 formed therein through which a cord 28 may pass. A splice joint 24A might be used in a number of situations. One situation would be where one or more sections of a large expensive shade have flaws or become damaged or there are flaws in the material to be used for the shade and it is desired to replace such sections without replacing the entire shade or material. This embodiment of the invention would permit the flawed or damaged section or sections to be removed and either the remaining sections spliced together, resulting in a slightly shorter shade, or, when necessary, replacement sections being spliced in place of the removed sections Another situation might be where it was necessary to splice together two pieces of standard-length material in order to achieve a custom shade of desired length and/or width. A third situation might be where, to achieve a particular aesthetic effect or particular functional objective, two sections of different material are spliced together in a single shade. The pieces of material spliced together might be of the same or different widths, density, color or pattern. The ability to achieve an invisible splice joint in a shade thus provides substantial flexibility in shade design.

The embodiments of the inventions discussed to this point utilize a single pleated piece of material 14. However, in certain applications, improved insulation and desired aesthetic effect can be achieved with a shade having two pieces of material, at least one of which is a pleated piece of material with tabs, which are connected either in a honeycomb, prismatic or in other configurations to be discussed. Referring to FIG. 5, an embodiment of the invention having a front piece of prepleated material 14F and a rear piece of prepleated material 14R is shown. Pleated pieces of material 14F and 14R are connected in standard fashion to a headrail 10' and at the other end, to a bottomrail 12' having end caps 21. The exact manner in which the connections are made to headrail 10' and bottomrail 12' do not necessarily form part of the present invention.

Figure 5A:
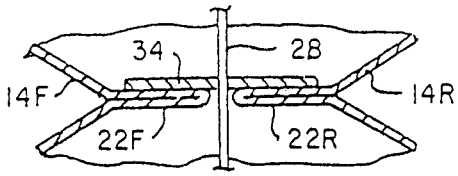
FIG. 5A is a side sectional view of a portion of a shade of a first variation of the embodiment of the invention shown in FIG. 5.
Figure 6:
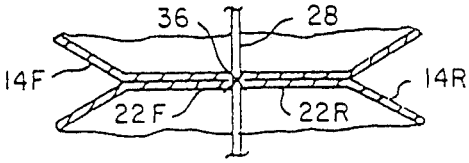
FIG. 6 is a side sectional view of a portion of a shade of a second variation of the embodiment of the invention shown in FIG. 5.
Figure 5:
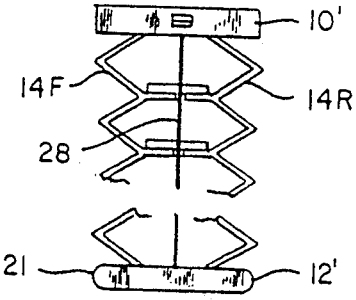
FIG. 5 is a side sectional view of a portion of a shade of a fourth embodiment of the invention which shade is formed of two pieces of material.

In the embodiment of the invention shown in FIG. 5, the interior pleats of piece of material 14F have tabs 22F formed thereon and the interior pleats of material 14R have tabs 22R formed thereon As may be best seen in FIG. 5A and FIG. 6, a cord 28 passes between corresponding tabs 22F and 22R. While only a single cord 28 is shown in FIGS. 5, 5A, and 6, it is to be understood that for most shades there will be at least two such cords, and that the number of such cords for a given shade will vary with the width of the shade.

For the embodiment of the invention shown in FIG. 5A, corresponding tabs 22F and 22R are secured together by a piece of material 34 which spans the tabs over substantially the entire width of the shade but is not necessarily continuous and is secured to each of the tabs by being glued, sewn, welded or by other suitable attachment means. Cords 28 pass either through holes formed in piece of material 34, or through spaces between the pieces of material where material 34 is not continuous, and between corresponding tabs 22F and 22R. In the alternative, as shown in FIG. 6, corresponding tabs 22 may be butted against each other and secured together by a butt bond 36, or by gluing, stitching or other suitable means. Cord holes are formed in the joint between the tabs.

Figure 7:
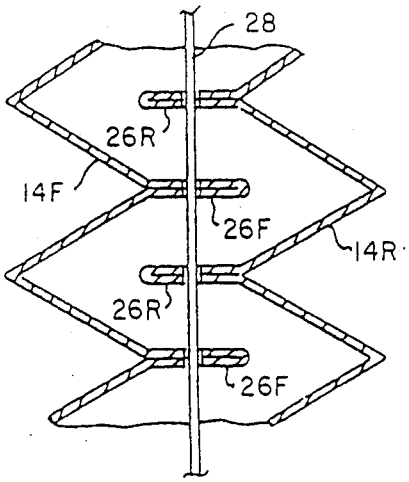
FIG. 7 is a side sectional view of a portion of a shade of a fifth embodiment of the invention.
Figure 8:
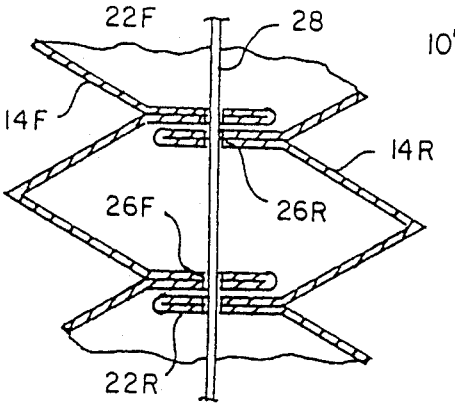
FIG. 8 is a side sectional view of a portion of a shade of a sixth embodiment of the invention.
Figure 9:
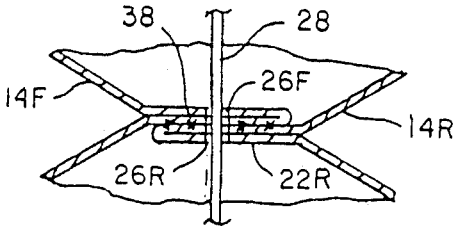
FIG. 9 is a side sectional view of a portion of a shade of a seventh embodiment of the invention.
Figure 10:
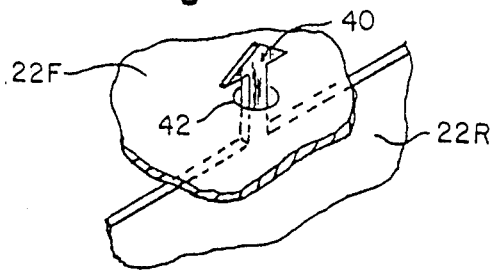
FIG. 10 is a perspective view of a tab joint for an eighth embodiment of the invention.
Figure 11:
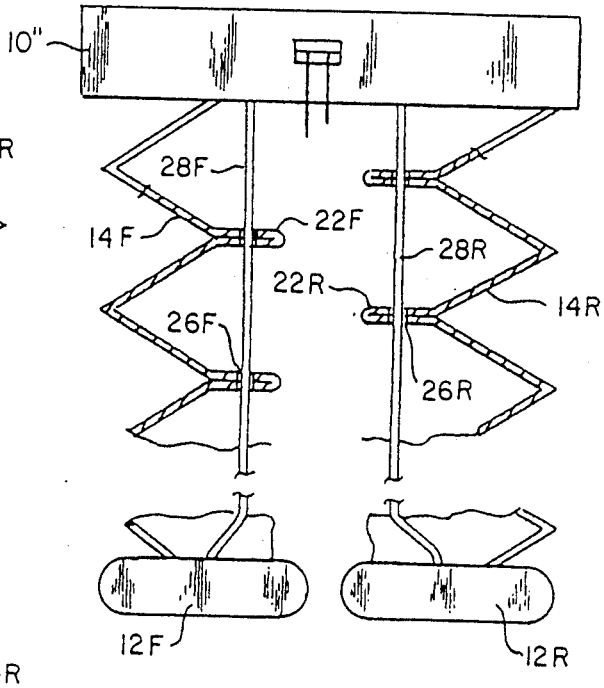
FIG. 11 is a side sectional view of a shade of a ninth embodiment of the invention.

FIG. 7 shows an alternative embodiment of the invention which offers a slightly different functional and aesthetic effect. In this embodiment of the invention, the facing pleats of the two pieces of material 14F and 14R are spaced vertically from each other by one pleat and the holes 26F and 26R in the pleats are aligned so that a single cord 28 passes through corresponding holes 26 in each set of tabs, securing the tabs and the pieces of material together. For the embodiment of the invention shown in FIG. 7, the cord 28 is the only means securing the two pieces of material together The embodiment of the invention shown in FIG. 8 is the same as that shown in FIG. 7 except that the facing tabs 22F and 22R are not vertically spaced from each other so that a honeycomb effect, such as that shown in FIG. 5, is achieved. For the embodiment of the invention shown in FIG. 8, there is nothing holding corresponding tabs 22F and 22R together except the cord(s) 28. The embodiment of the invention shown in FIG. 9 is identical to the embodiment shown in FIG. 8 except that, in addition to being held together by cord(s) 28, corresponding tabs 22F and 22R are also held together by a weld joint 38 or by other suitable means such as gluing or sewing The embodiment of the invention shown in FIG. 10 is the same as that shown in FIG. 9 except that instead of corresponding tabs 22F and 22R being held together by welding, gluing or the like, each tab 22R has a plurality of barbs 40 formed therein, one of which is shown in FIG. 10, and each of the tabs 22F has a corresponding plurality of openings 42 formed therein. Corresponding tabs are secured together by passing the barbs 40 through corresponding openings 42. While for purposes of illustration, barbs 40 have been shown formed in tabs 22R and openings 42 in tabs 22F, the tabs in which the barbs and openings are formed could of course be reversed FIG. 11 shows another alternative embodiment of the invention in which pieces of material 14F and 14R are connected to a common headrail 10", but each piece of material is connected to a separate bottomrail 12F and 12R. Bottomrails 12F and 12R could be of the type shown in FIG. 3 or FIG. 3A. The advantage of the embodiment of the invention shown in FIG. 11 is that cords 28F and 28R may be independently operated so that, for example, piece of material 14F may be semi-transparent affording some degree of privacy while permitting light to enter the room during the day while piece of material 14R may be opaque providing complete privacy when lowered at night. Both shades may be raised to permit maximum light to enter the room or for cleaning. Shade I4R may have tabs as shown in FIG. 11 or may be a standard shade without tabs. This is because cord visibility is not a problem for this shade; however, tabs would still be desirable to improve insulation, rigidity, and to eliminate light leakage.

Figure 12:
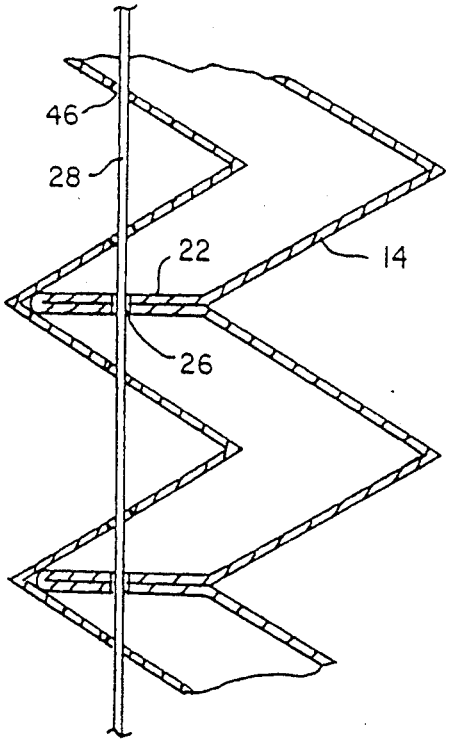
FIG. 12 is a side sectional view of a portion of a shade of a tenth embodiment of the invention.

FIG. 12 shows still another embodiment of the invention wherein a piece of material 14 having tabs 22 is combined with a piece of material 44 which is a standard piece of pleated material having holes 46 formed through each shade section For this embodiment of the invention, the facing pleats are vertically spaced by one pleat length so that holes 26 in tabs 22 may be aligned with the holes 46 permitting a single cord 28 to pass through corresponding holes 26 and 46 to secure the two pieces of material together By having the piece of material 14 as a front piece of material, cord invisibility and hole elimination are obtained with an interesting aesthetic effect.

Figure 17:
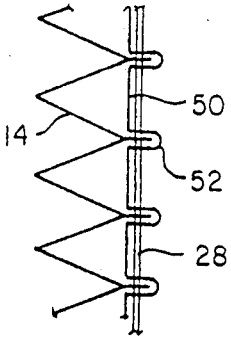
FIG. 17 is a side sectional view of a prismatic embodiment of the invention.

FIG. 17 shows a prismatic embodiment of the invention wherein a pleated shade 14 has a shorter prepleated layer 50 mounted behind it with tabs 52 being simultaneously formed in both layers. The simultaneous forming of the tabs may be accomplished by forming both tabs in a single welding operation or the tabs could be formed on layer 14 with an adhesive bond which is then reheated when both layers are welded.

The resulting cellular configuration of triangular prisms has a very strong structural geometry while also providing insulation. The double welded tabs are particularly strong and rigid and the configuration provides more pleat depth and insulation while taking up significantly less stack space than a honeycomb configuration. Different fabrics could also be utilized for the front and rear layers 14 and 50 respectively to achieve a variety of functional and aesthetic effects.

For any of the embodiments of the invention shown in FIGS. 5–12 and 17, a vapor barrier may be obtained, to prevent liquid condensation on the window pane and enhance the insulating properties of the shade, by forming the rear piece of material 14R of a plastic film or other nonpermeable material It is also apparent that a pleated piece of material 14 having tabs 22 formed therein may be combined with an unpleated piece of material in the embodiments of the invention shown in FIGS. 5–11 which piece of material has tabs formed therein, or which does not have tabs. Further, while the invention has been described above with reference to preferred embodiments thereof, the foregoing and other changes in form in detail may be made therein without departing from the spirit and scope of the invention.

What is claimed is:

1. A shade of the type having a shade body having a top, a bottom and a centerline and constructed of pleated material, the pleated material having a front face and a rear face and adapted to receive and restrain at least one cord extending from the top to the bottom of said shade body, said shade body further having a series of tabs extending from the rear face thereof, wherein said shade comprises:

(a) a headrail having the top of said shade body affixed thereto and said at least one cord extending therefrom; and (b) a bottomrail that is generally triangular in cross section and is affixed to the bottom fo said shade body at a point on said shade body where a tab is extending therefrom, and having said at least one cord affixed thereto, said bottomrail having a center of mass which is offset from said center line of said shade body, said center of mass being offset towards said rear face of said shade body, said bottomrail being further comprised of:

(i) a housing; and (ii) cord receiving means, mounted within said housing.

2. A shade as described in claim 1 wherein said shade body at least partially supports the weight of said bottomrail.

3. A shade as described in claim 2 wherein said headrail has a front section and a rear section and said shade body is affixed at a tab to said headrail on said rear section.

4. A shade assembly including a bottomrail and a shade body, wherein the shade body is of the type constructed of pleated material having a series of tabs extending outwardly from a rear face thereof, wherein the bottomrail is generally triangular in cross section and wherein the bottomrail comprises:

(a) a housing comprised of a main body having a cavity therein and a tongue extending in a direction opposite the rear face of the shade body, wherein said tongue has a termination point at one end opposite said main body, and said housing further comprising a leaf extending from said termination point of said tongue to said main body, said leaf forming a side of said triangular shaped bottomrail; and (b) cord receiving means, mounted within said housing.

5. A shade assembly including a bottomrail and a shade body of the type constructed of pleated material having a series of tabs extending outwardly from a rear face thereof, wherein the bottomrail is generally triangular in cross section and wherien the bottomrail comprises:

(a) a housing comprised of a main body having a cavity therein, said housing further having a top and a bottom surface, said top surface having a tongue extending outwardly therefrom, said bottom surface having a leaf mounted thereon, said leaf and said tongue extending to a common point, forming two sides of said triangular bottomrail, a third side formed by said main body; and (b) cord receiving means, mounted within said housing.

6. A shade assembly as described in claim 5, wherein said shade body is affixed to said tongue at said common point.

7. A shade assembly as described in claim 6 wherein said shade body is also affixed to said main body at a point where said tongue extends from said main body.

8. A shade assembly including a bottomrail and a shade body of the type constructed of pleated material having a series of tabs extending outwardly from a rear face thereof, wherein the bottomrail is generally triangular in cross section and wherien the bottomrail comprises:

(a) a housing comprised of a main body having a cavity therein, said housing further having a top and a bottom surface;

(b) cord receiving means mounted within said housing wherein said cord receiving means has a tongue extending outwardly therefrom; and (c) a leaf mounted on said bottom surface of said housing, said leaf and said tongue extending to a common point, forming two sides of said triangular bottomrail, a third side formed by said main body.

9. A shade assembly as described in claim 8, wherein said shade body is affixed to said tongue at said common point.

10. A shade assembly as described in claim 9 wherein said shade body is also affixed to said cord receiving means at a point where said tongue extends from said cord receiving means.

11. A shade assembly as described in claim 10 wherein said tongue is arcuate in shape.

12. A shade assembly as described in claim 8 wherein said bottomrail has a center of mass and said shade body has a centerline, said bottomrail further cmoprising a weight mounted on said housing, said weight being offset from said centerline.

13. A shade assembly including a bottomrail and a shade body of the type constructed of pleated material having a series of tabs extending outwardly from a rear face thereof, wherein said bottomrail is generally triangular in cross section and wherein the bottomrail comprises:

(a) a housing having a top surface, a bottom surfaee and a front surface; and (b) a clamp means affixed to the exterior of said housing, said clamp means having a top surface and a front surface, mounted such that said front surface of said clamp means covers said front surface of said housing and said top surface of said clamp means covers said top surface of said housing; and (c) cord receiving means, mounted within said housing.

14. A shade assembly as described in claim 14 wherein said cord passes through the top surface of the clamp means.

15. A shade assembly as described in claim 14 wherein said clamp means further comprises a tongue extending outwardly therefrom in the direction of said front face of said shade body.

16. A shade assembly as described in claim 15 wherein said shade body is affixed to said tongue.

17. A shade assembly as described in claim 16 wherein said shade body is also affixed to said top surface of said clamp means.

18. A shade assembly as described in claim 6 wherein said shade body forms a first side and said tongue forms a second side of a triangle forming a portion of the triangular bottomrail.

* * * * *

UNITED STATES PATENT AND TRADEMARK OFFICE

CERTIFICATE OF CORRECTION

PATENT NO. : 5,176,192

DATED : January 5, 1993

INVENTOR(S) : REN JUDKINS

It is certified that error appears in the above-identified patent and that said Letters Patent is hereby corrected as shown below:

Column 16, line 13, change "fo" to --of--.

Column 17, line 31, change "cmoprising" to --comprising--.

Signed and Sealed this

Fifteenth Day of February, 1994

*Attest:*

Bruce Lehman

BRUCE LEHMAN

*Attesting Officer*

*Commissioner of Patents and Trademarks*